US009027754B2

(12) United States Patent
Berger et al.

(10) Patent No.: US 9,027,754 B2
(45) Date of Patent: May 12, 2015

(54) RESEALABLE AND REFILLABLE WIPES DISPENSER

(71) Applicant: Kimberly-Clark Worldwide, Inc., Neenah, WI (US)

(72) Inventors: Maggie VanderHeiden Berger, Appleton, WI (US); Kevin Christopher Possell, Middleton, WI (US); Jason Robert Boon, Appleton, WI (US); Matthew Chace Carpenter, North Attleboro, MA (US); Mark Joseph Guarraia, Cranston, RI (US); Daniel Patrick Smith, Portsmouth, RI (US)

( * ) Notice: Subject to any disclaimer, the term of this patent is extended or adjusted under 35 U.S.C. 154(b) by 75 days.

(21) Appl. No.: 13/917,177

(22) Filed: Jun. 13, 2013

(65) Prior Publication Data

US 2014/0367296 A1 Dec. 18, 2014

(51) Int. Cl.

| | |
|---|---|
| ***A47K 10/42*** | (2006.01) |
| ***B65D 21/02*** | (2006.01) |
| ***B65D 43/22*** | (2006.01) |
| ***B65D 83/08*** | (2006.01) |

(52) U.S. Cl.

CPC ..... *A47K 10/421* (2013.01); *B65D 21/0233* (2013.01); *B65D 43/22* (2013.01); *B65D 83/0894* (2013.01)

(58) Field of Classification Search

CPC ..... A47K 10/421; A47K 2010/3266; B65D 21/0233; B65D 43/22; B65D 83/0805; B65D 83/0894

USPC ..... 206/494; 220/23.87, 23.89, 220/359.1–359.5; 221/46, 63, 48, 49

See application file for complete search history.

(56) References Cited

U.S. PATENT DOCUMENTS

| | | | | |
|---|---|---|---|---|
| 3,784,055 | A * | 1/1974 | Anderson | 221/46 |
| 4,000,816 | A * | 1/1977 | Spruyt | 206/205 |
| 4,180,178 | A * | 12/1979 | Turner | 220/281 |
| 4,350,263 | A * | 9/1982 | Hoffman | 220/359.1 |
| 4,391,309 | A * | 7/1983 | Steiner | 141/18 |
| 4,429,812 | A * | 2/1984 | Steiner et al. | 222/181.2 |
| 4,496,066 | A * | 1/1985 | Bullock, III | 215/320 |
| 4,598,835 | A | 7/1986 | Brownbill | |
| 5,050,737 | A * | 9/1991 | Joslyn et al. | 206/494 |
| 5,531,325 | A * | 7/1996 | Deflander et al. | 206/494 |
| 6,158,614 | A * | 12/2000 | Haines et al. | 221/63 |
| 6,648,163 | B2 * | 11/2003 | Porter et al. | 220/359.2 |
| 7,926,674 | B2 * | 4/2011 | Luburic | 220/359.2 |
| 2002/0005452 | A1 * | 1/2002 | Romme et al. | 242/598 |
| 2002/0056785 | A1 * | 5/2002 | Newman et al. | 242/588.3 |
| 2005/0029219 | A1 | 2/2005 | Taber et al. | |
| 2006/0191940 | A1 * | 8/2006 | Heyn | 220/359.1 |
| 2006/0283731 | A1 | 12/2006 | De-Vries | |

(Continued)

FOREIGN PATENT DOCUMENTS

| | | | |
|---|---|---|---|
| EP | 2 030 907 | A1 | 3/2009 |
| JP | 08-164973 | A | 6/1996 |
| JP | 2002-128141 | A | 5/2002 |

*Primary Examiner* — Bryon Gehman

(74) *Attorney, Agent, or Firm* — Kimberly-Clark Worldwide, Inc.

(57) ABSTRACT

Containers and dispensers for wiping substrates, and wet wiping substrates in particular, have been provided with lids, the containers have been susceptible to leakage, or difficulties in dispensing the contents. Provided is a refillable container for storing and dispensing wiping substrates. A refill cartridge containing wiping substrates having a peelable seal disposed on a first surface and a second surface for forming a seal with the container lid is provided.

19 Claims, 5 Drawing Sheets

(56) References Cited

U.S. PATENT DOCUMENTS

2007/0045315 A1* 3/2007 Evans et al. ..... 220/254.3
2008/0110920 A1* 5/2008 Hlista et al. ..... 221/45
2010/0252568 A1* 10/2010 Ciavarella et al. ..... 222/1
2011/0062043 A1* 3/2011 Bougoulas et al. ..... 206/514

* cited by examiner

RESEALABLE AND REFILLABLE WIPES DISPENSER

BACKGROUND

Containers for storing and dispensing wiping substrates and in particular wet wiping substrates are well known and widely available. Typically containers are designed to provide both storage and dispensing. Additionally, containers are often designed to be refillable—a consumer purchases a durable container with their first purchase of wiping substrates and then subsequently purchases only refill packs. The refill packs are generally a stack of substrates packaged in shrink wrap or an equivalent. To refill the container the consumer removes the packaging and inserts the stack of substrates into the container. This simplicity enables considerable cost savings to be passed on to the consumer. However, the consumer is required to handle the substrate directly, which may be unsatisfactory.

To avoid having the consumer directly contact the substrate when refilling, substrate refills may be provided in packaging that is inserted directly into the durable container for use. For example, refill packs may consist of flexible films produced in flowpack lines and filled with wiping substrates. The sack is sealed with a heat weld to form a refill pack. The user must orient the pack in the dispenser according to the printed instructions on the flowpack with the correct end of the pack facing the dispensing hole and then break the film to start the first wipe. Installing such refill packs by the user is somewhat difficult and often time-consuming, and the welded seams may be prone to leakage, particularly when housing premoistened wipes. Further, the refill packs often fit poorly in the container, particularly after a majority of the wipes have been dispensed. This poor fit may adversely affect dispensing and make it difficult for a user to remove the refill pack after it has been emptied.

Accordingly there is a need in the art for a refillable container, particularly a refillable container for storing and dispensing wiping substrates that is easy to refill, effectively dispenses and stores wipes, and is aesthetically pleasing.

SUMMARY

The present disclosure is generally directed to a container and dispensing system, and more particularly to a refillable container that includes a container base and a lid, where the base is adapted to receive a refill cartridge and the lid is adapted to seal the cartridge when the lid is placed in a closed position. Generally the refill cartridge is provided with a first seal that is preferably peelably adhered thereto so as to protect the contents of the cartridge during shipping and storage. In use, the user prepares the cartridge for use by removing the peelable seal and then inserts the cartridge into the base. The user then forms a second seal by closing the lid thereby forming a second seal between the lid and the refill cartridge which protects the contents of the cartridge during use. The first and second seals are preferably formed on different parts of the refill cartridge. For example, in a particularly preferred embodiment the first seal is formed along a first top surface of the cartridge lying in a first plane and the second seal is formed along a second top surface of the cartridge lying in a second plane. Preferably the first and second planes do not reside in the same plane. In this manner two distinct sealing surfaces are provided.

Accordingly in one embodiment the present invention provides a resealable container system comprising a base, a refill cartridge and a lid, the cartridge having a top peripheral edge, an annular rim and a skirt extending therefrom, the annular rim having a first top surface lying in a first plane, and the skirt having a second top surface lying in a second plane wherein the first and second planes do not lie in the same plane.

In another embodiment the present invention provides a refillable wipes dispenser system comprising a cartridge having a wall portion defining a storage volume and an open top, the open top circumscribed by a peripheral edge, an annular rim having a first top surface lying in a first plane and a skirt extending from the annular rim, the skirt having a second top surface lying in a second plane, a first seal peelably adhered to the first top surface; a lid configured to cover the open top in a sealing arrangement, the lid comprising a cover portion, a lid peripheral edge and a sealing member configured such that when the lid is in a closed position the sealing member contacts the second top surface to form a second seal; and wherein the first and second planes do not lie in the same plane.

DETAILED DESCRIPTION

Figure 1:
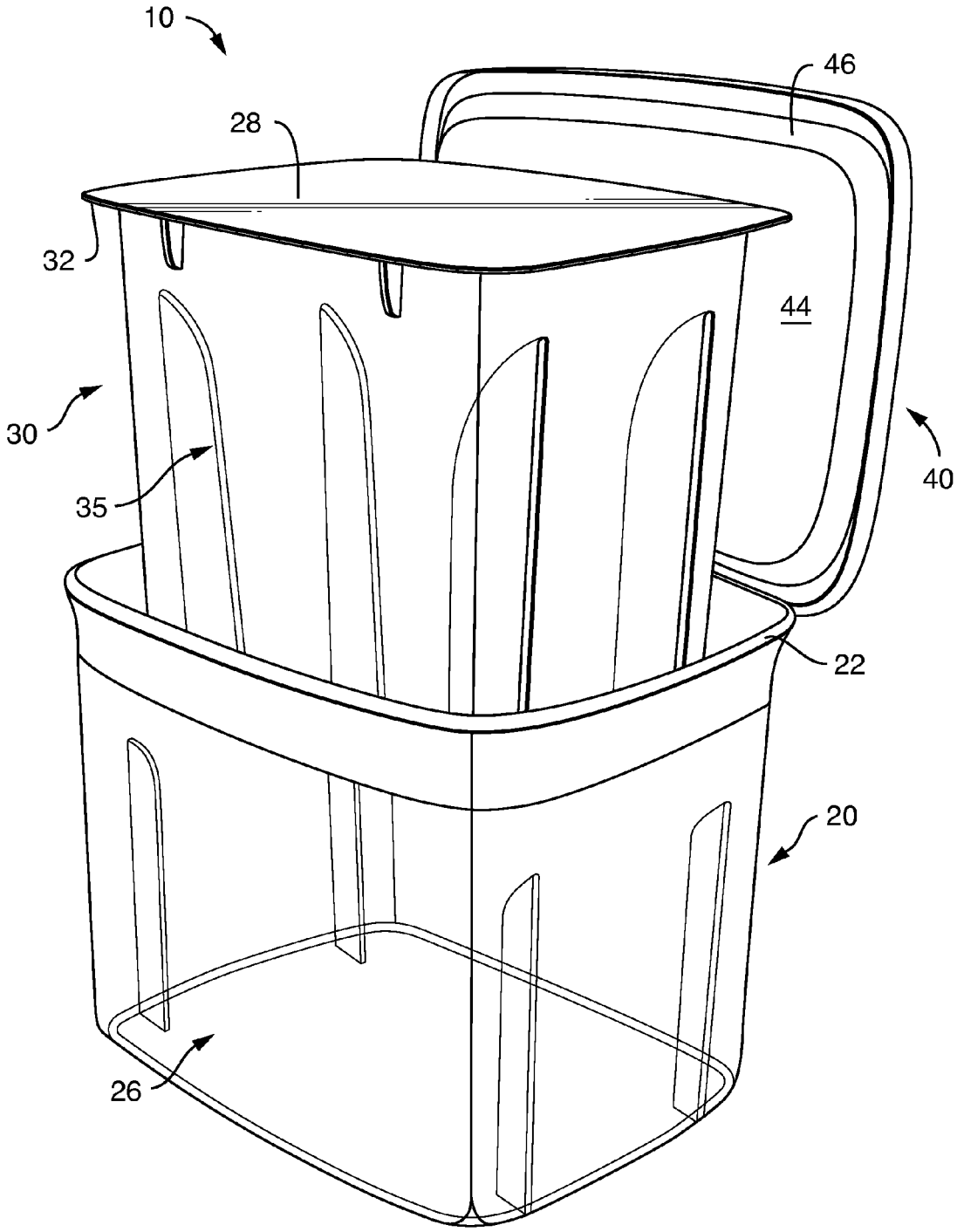
FIG. 1 is a perspective view of a dispenser system according to one embodiment of the present invention.

The disclosed container and system solves or improves upon the problems with and disadvantages of currently known refillable storage and dispensing containers by providing a storage container system that includes a container base, a refill cartridge and a lid, where the cartridge is preferably rigid and easily removable from the container base. The refill cartridge is provided with a rim having a top surface lying in a first plane and a seal disposed on the top surface. In this manner a refill cartridge is provided having a first seal disposed in a first plane. The first seal acts to protect the contents of the cartridge during shipping and storage. The first seal is preferably a peelable seal that is adhered to the cartridge rim and covers an open first end of the cartridge. The first seal is generally removed by a user prior to inserting the cartridge into the base and using the contents.

The disclosed container base includes a lid having a sealing member disposed about its periphery. In use the sealing member is brought into contact with the top surface of the cartridge skirt, which extends from the cartridge rim, upon which the first seal is disposed. In this manner a second seal is formed in a second plane when the sealing member contacts the top surface of the skirt, thereby sealing the cartridge in the container. Additionally, the structure of the container system allows the container base, refill cartridge and lid to be combined in a stable, secure manner to prevent separation and to facilitate both storage and dispensing.

Thus, in one preferred embodiment the present invention provides a refillable storage and dispensing container and a container system comprising a base, a refill cartridge, and a lid. The lid and base are preferably connected to one another, while the refill cartridge is removable from the system. The refill cartridge is provided with a first seal disposed in a first plane that is removed by a user prior to using the cartridge. Once the first seal is removed and the cartridge is disposed in the base, a second seal is formed by closing the lid, bringing a sealing member into contact with the cartridge rim to form a second seal in a second plane.

The refillable dispenser and storage system of the present invention is particularly well suited for dispensing and storing wiping substrates, including, but not limited to wipers, towels, and the like. Such substrates may be stacked, folded, interfolded, rolled, or in any format as are known for such substrates. The substrates may be either wet or dry. An exemplary embodiment of this invention includes a plastic base for receiving a refill cartridge with an air-tight lid system, suitable for storage of wet wiping substrates, for example. The lid is connected to the base by a living hinge. A sealing member, such as a compressible seal, is fitted into an inner seal groove or channel formed in the lid. The lid is configured for movement between an extended position in which the lid is open and the contents of the refill cartridge are accessible, and closed position in which the seal contacts the refill cartridge to form a seal between the lid and the cartridge, thereby preventing the egress of water from the wet wiping substrate and maintaining the substrate in a wet condition.

Turning now to the drawings, FIG. 1 shows one example of a dispenser system 10 constructed in accordance with the teachings of the present invention. The disclosed dispenser system 10 generally has a base 20, a lid 40, and a refill cartridge 30, each to be described below in greater detail. The base 20, lid 40, and refill cartridge 30 are shown be somewhat square-like (i.e., four-sided) or generally rectangular shape. However, other shapes and configurations of the base, cartridge and lid, such as round or circular, are contemplated and are intended to fall within the scope of the invention. The invention is not to be limited to a specific container base, cartridge, and lid perimeter shape or overall contour. In general, the refill cartridge is sized to fit within the base and the lid is sized to fit over the base during use.

With further reference to FIG. 1, the structural details of a representative refill cartridge 30 and base 20 are shown. The disclosed cartridge 30 is generally shaped to be inserted into the base 20. Both the cartridge 30 and base 20 are illustrated having a continuous circumferential side wall (38 in the case of the cartridge and 26 in the case of the base) and a bottom (not illustrated in the case of the cartridge) that defines an interior storage space. In this example, the side wall and bottom form a substantially four-sided shape, but with rounded corners, and a slight outward and upward taper to the side wall, as are known in the art. As noted above, other base shapes and configurations are contemplated and fall within the scope of the invention. The specific dimensions of the side wall and bottom may vary and yet remain within the scope of the invention as well. The side wall extends upwardly and generally outwardly from a perimeter of the bottom and terminates at a top edge that defines an open top. For sealing the base 20 and the cartridge 30 a lid 40 is generally provided and is attached along the top edge 22 by a hinge (not illustrated in FIG. 1).

Figure 2A:
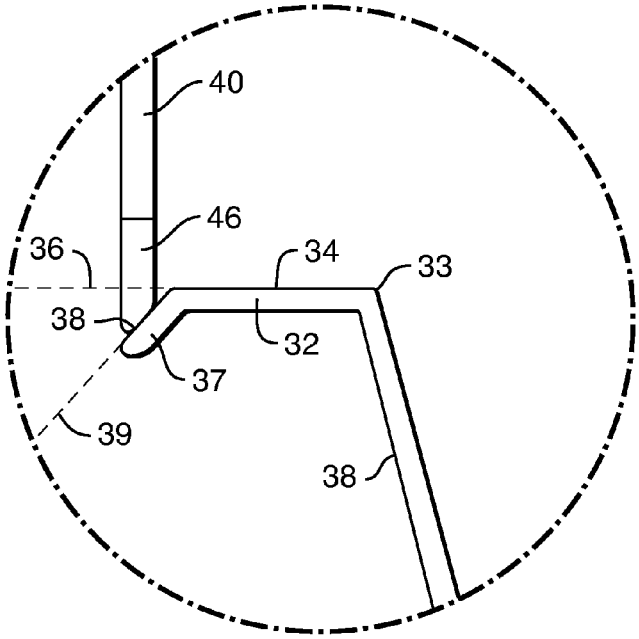
FIG. 2A is a detail view of a seal formed between a sealing member and a refill cartridge according to one embodiment of the present invention.
Figure 2B:
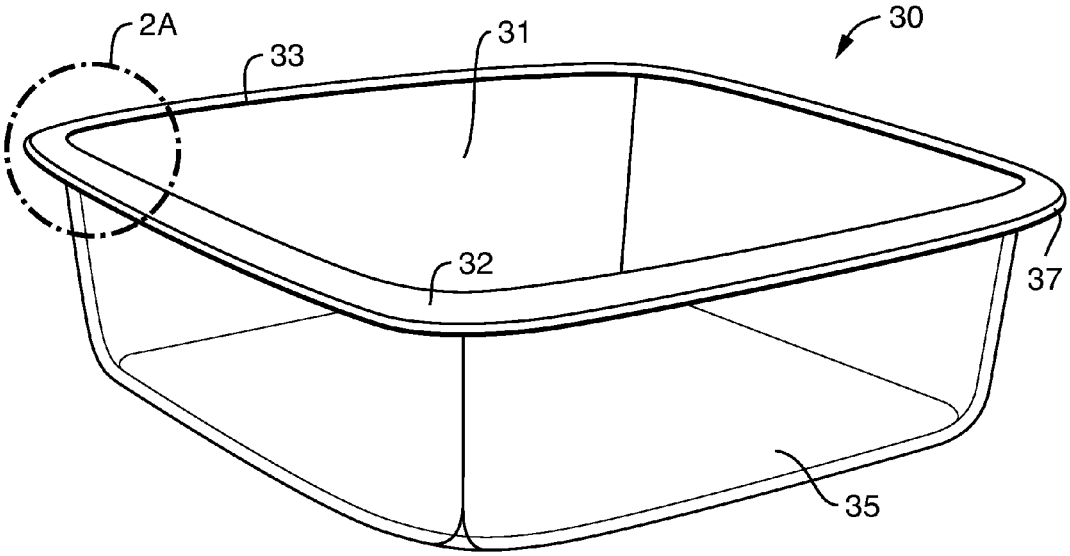
FIG. 2B is a perspective view of a refill cartridge according to one embodiment of the present invention.

Now with reference to FIGS. 2A and 2B an exemplary embodiment of a refill cartridge 30 is illustrated. The refill cartridge 30 in this embodiment takes the form of a four sided container having generally a cup shape with an open top 31. The refill cartridge 30 has an annular sidewall 38 defining four sides of the cartridge. The cartridge 30 is generally shaped to receive a material to be stored and dispensed. The annular sidewall 38 terminates at a top peripheral edge 33, which defines the edge of the open top 31. Extending from the top peripheral edge 33 is an annular rim portion 32, which in the illustrated embodiment is generally planar and has a top surface 34 lying in a first plane 36. The rim portion 32 extends away from the top peripheral edge 33 to a rim edge, which generally defines the transition from the rim portion 32 to the rim skirt 37, which has a top surface 38 lying in a second plane 39. In this manner the refill cartridge has at least two top surfaces lying in different planes, the top surface 34 of the annular rim portion 32 defining a first plane 36 and the top surface 38 of the skirt 37 defining a second plane 39. As will be discussed in more detail below, the arrangement of the at least two surfaces in this manner provides for two distinct sealing surfaces. As such a first seal may be formed along the first top surface 34 and a second seal may be formed along the second top surface 38.

The refill cartridge (as well as the base) can be formed of any suitable material and fabricated from any likewise suitable manufacturing process. In one example, the refill cartridge can be injection molded from a polypropylene material, a polycarbonate material, or the like. In addition, the refill cartridge can also be formed from a clear, translucent, semi-transparent, or opaque material and can be formed in any desirable color. In one example, the refill cartridge can be formed of a colored material so as to make the refill cartridge easy for a consumer to locate.

In a particularly preferred embodiment, such as that illustrated in FIG. 1, the open top of the cartridge 30 is at least partially covered by a seal 28, which is generally removed prior to use. The seal protects the contents of the cartridge from damage during shipping and storage and to prevent leakage or spillage. In a particularly preferred embodiment the seal 28 is a peelable seal, the edges of which are adhesively adhered to the cartridge rim 32 along the first top surface 34. In use, a user removes the seal using a peeling action. The seal is generally disposed after the cartridge is opened and the contents of the cartridge are protected in-use by the seal formed between the lid sealing member and the cartridge. To facilitate seal removal in certain embodiments the seal may be provided with various types of pull tabs or similar devices.

In a particularly preferred embodiment the refill cartridge comprises an injection molded polypropylene base and a peelable seal affixed thereto with an adhesive. A dry or wet wiping substrate is provided in the refill unit. When a user is ready to replace an existing cartridge, the user opens the lid, grasps the rim of the cartridge and removes the cartridge from the base. The user then removes the peelable lid from a new refill cartridge, places the refill cartridge in the base and seals the dispenser by closing the lid, forming a seal between the sealing member and the top surface of the rim skirt.

In certain embodiments the container system disclosed and described herein may be provided with a connecting structure for connecting the base, lid, or refill cartridge with one another in a number of optional arrangements. In one aspect of the invention, the refill cartridge disclosed herein is provided with a plurality of elongated lips or projections that extend radially outward from the refill cartridge wall. For example, in one embodiment each of the four sides of the refill cartridge includes a projection centrally located on each side of the refill cartridge wall. The base may include a groove aligned with the corresponding projection such that when the refill cartridge is inserted into the base, the combination of the projections and grooves combine to support and interconnect the parts.

Now turning to the lid, which is preferably configured to overlay and close off the open base top near the upper end of the base side wall. Accordingly, it is preferred that the lid is formed with features that allow it to cover and seal the open top of the base. In one embodiment the lid may comprise a main panel with a top side, a bottom side, and a perimeter skirt. The skirt circumvents the perimeter of the main panel and more preferably extends around the main panel and generally perpendicularly down from the plane of the main panel. In a particularly preferred embodiment the skirt wall is positioned inward from an outer edge of the main panel resulting in a lid rim projecting radially outward from the lid beyond the skirt wall.

The lid may be operatively connected to the base, or in other embodiments may be removably connected. In those embodiments where the lid is operatively connected to the base, the lid is preferably connected to the base by a hinge. The hinge can be a "living hinge", a "pivoting hinge", or another type of hinge. A living hinge is a hinge formed with the base and the lid as a single piece. A living hinge can be configured to facilitate the lid being able to spring away from the base when the closure system is to be opened. A pivoting hinge is formed at substantially the same time as the body portion (or the lid portion), wherein the body portion and the lid portion are formed as separate pieces and snapped together at the hinge to combine the two pieces into a single container assembly.

The hinge provides ease of moving the lid. For example, the hinge operatively connects the lid to the base in a movable arrangement, wherein the lid comprises at least two positions, namely, a first position and a second position. When in the first position, the lid is "open" (or moved away from the base), which allows product (e.g., a wiping substrate) to be dispensed from the refill cartridge. When the lid is in the second position, the lid is closed or engaged with the base providing a secure seal according to various embodiments disclosed herein. Thus, the hinge allows the lid to be moved away from the base for dispensing and/or for filling, as well as moved into contact with the base for storage or transport purposes.

In certain embodiments the lid is not connected to the base with a hinge, but rather the lid fits onto base by fitting the skirt wall over the base's top edge. In this in-use configuration, the lid would cover and close off the open top to seal the storage space. In other embodiments the lid is operatively connected to the base by a hinge and is formed with the base as a one-piece construction rather than as a plurality of parts separately attached together. In this manner the lid and base are joined by a living hinge.

In a particularly preferred embodiment, such as that illustrated in FIG. 1, the lid 40 includes a central portion 44 sized to substantially close off the open end of the base and a sealing member 46, which in certain embodiments may be held in a channel formed in the lid 40, and is brought into compression between the lid and the top surface 38 of the skirt 37 when the lid 40 is closed. Preferably the sealing member is formed from a material that is different than the material used to form the lid, more preferably the sealing member is formed from a material that provides some stiffness, yet is resiliently flexible and pliable and has an elasticity to attain a seal with the cartridge skirt. Accordingly, in a preferred embodiment the sealing member may be an extruded or molded elastomeric member and more preferably is formed from silicon or TPE (thermoplastic elastomer). In certain embodiments the sealing member is a compressible material and preferably a thermoplastic elastomer selected from the group consisting of butadiene rubber, styrene-butadiene rubber, butyl rubber, ethylene-propylene rubber, ethylene-propylene-diene rubber, polyisoprene rubber, polychloroprene rubber, silicon rubber, neoprene, nitrile rubber and blends thereof. In an exemplary embodiment, the sealing member is an injection-molded unitary part and has a continuous cross section. The dimensions of the sealing member, in an exemplary embodiment, are selected to optimize moldability of the seal and compression of the seal in a sealing configuration.

As further illustrated in FIG. 1, the lid 40 includes a cover surface 44 which is sized to extend over the open top 31 of the cartridge 30 when the lid 40 is attached to the container and in a closed position. The cover surface 44 is generally planar in this embodiment, and is connected to a lid peripheral portion by a beveled or angled surface portion, providing a shallow dome structure. The lid 40 is connected to the base 20 portion of the container connected hinge and more preferably a living hinge. As such, it will be appreciated that in an exemplary embodiment, the lid is a unitary structure, fabricated from a plastic material such as polypropylene by injection molding.

The second seal, the seal formed between the sealing member and the rim skirt, may be configured in a number of different ways. Generally, it is preferred that the surface contacted by the sealing member does not lie in the same plane as the sealing surface contacted by the first seal. For example, as illustrated in the cross-sectional view of FIG. 2B, the sealing member 46 comprises a single molded elastomeric bead that contacts the downturned top surface 38 of the skirt 37 which lies in a second plane 37, which is different than the plane 36 of the rim 32 top surface 34. In the illustrated embodiment the angle between the planes, angle $\alpha$, is generally less than about 90°, such as from about 30 to about 60°.

Figure 3:
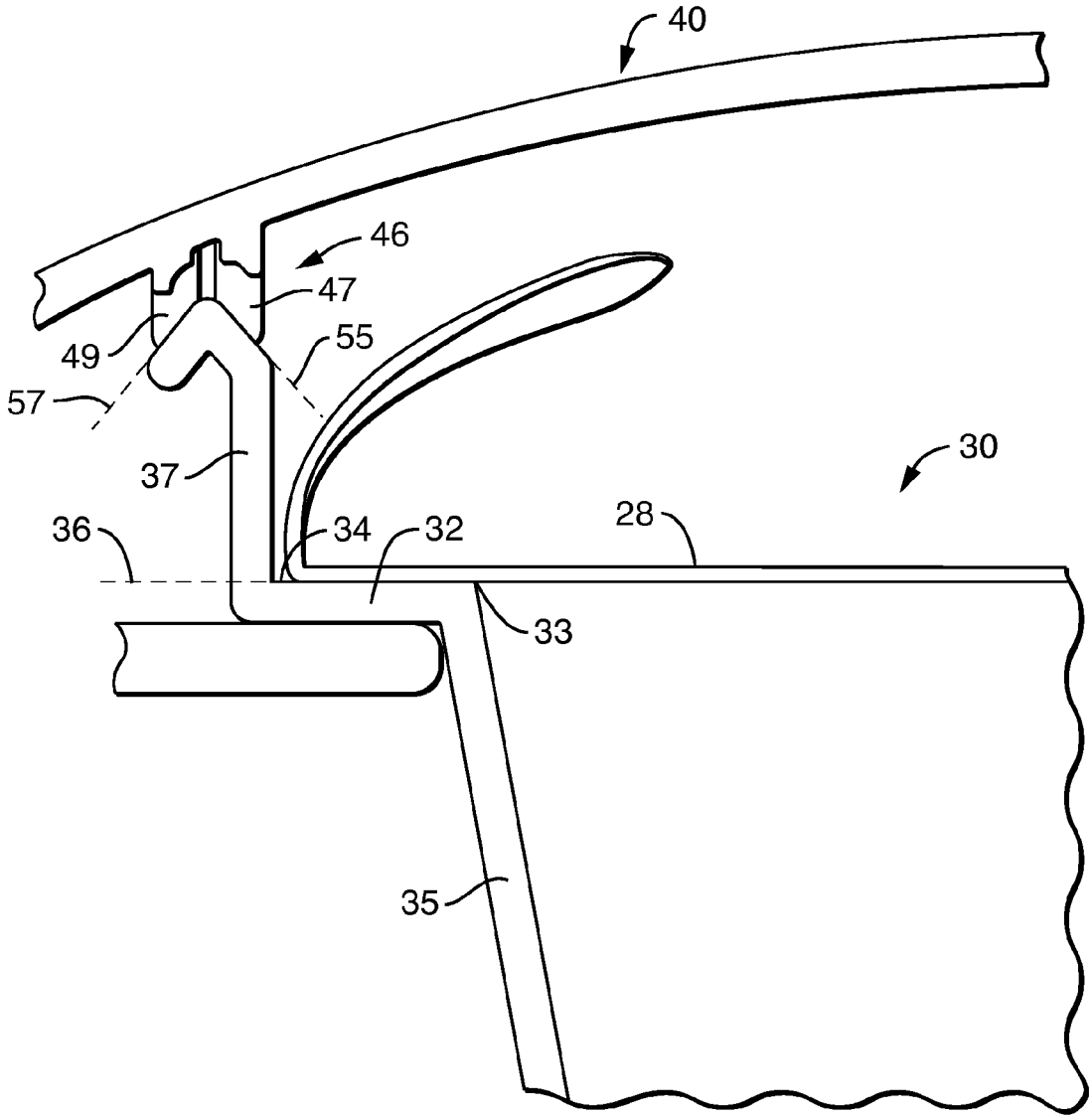
FIG. 3 is a detailed partial view illustrating the seal formed between a sealing member and a refill cartridge according to another embodiment of the present invention.

In another embodiment, such as that illustrated in FIG. 3, the sealing member 46 comprises a first 47 and a second 49 molded elastomeric bead and the sealing surface comprises a skirt 37 that rises above the rim 32 and terminates in a pair of angled surfaces that define a second plane 55 and a third plane 57. The second 55 and third 57 planes are not in the same plane as the first plane 36 defined by the top surface 34 of the annular rim portion 32. In the illustrated embodiment the second and third seals (formed between the first and second beads and the top surfaces of the skirt) are elevated above the first seal (formed between the peelable seal and the top surface of the rim).

Figure 4:
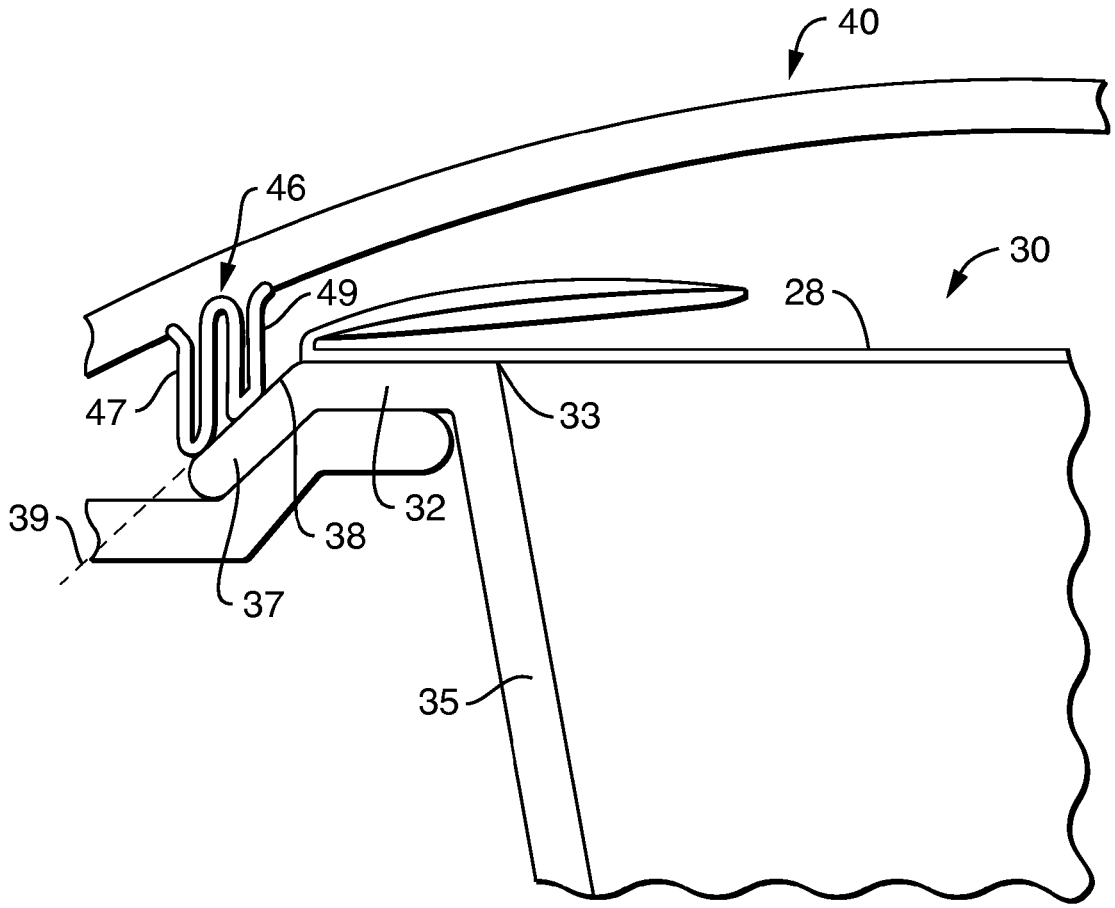
FIG. 4 is a detailed partial view illustrating the seal formed between a sealing member and a refill cartridge according to still another embodiment of the present invention.

In a similar manner, such as that illustrated in FIG. 4, the cartridge 30 may be resealed by contacting a sealing member 46 comprising a first 47 and a second 49 molded elastomeric bead with a sealing surface formed by the upper surface 38 of the downward extending skirt 37 having a top surface 38 lying in a second 39. The first 36 and second 39 planes do not lie in the same plane. As illustrated the second and third seals (formed between the first and second beads and the top surface of the skirt) are positioned below the first seal (formed between the peelable seal and the top surface of the rim).

Figure 5:
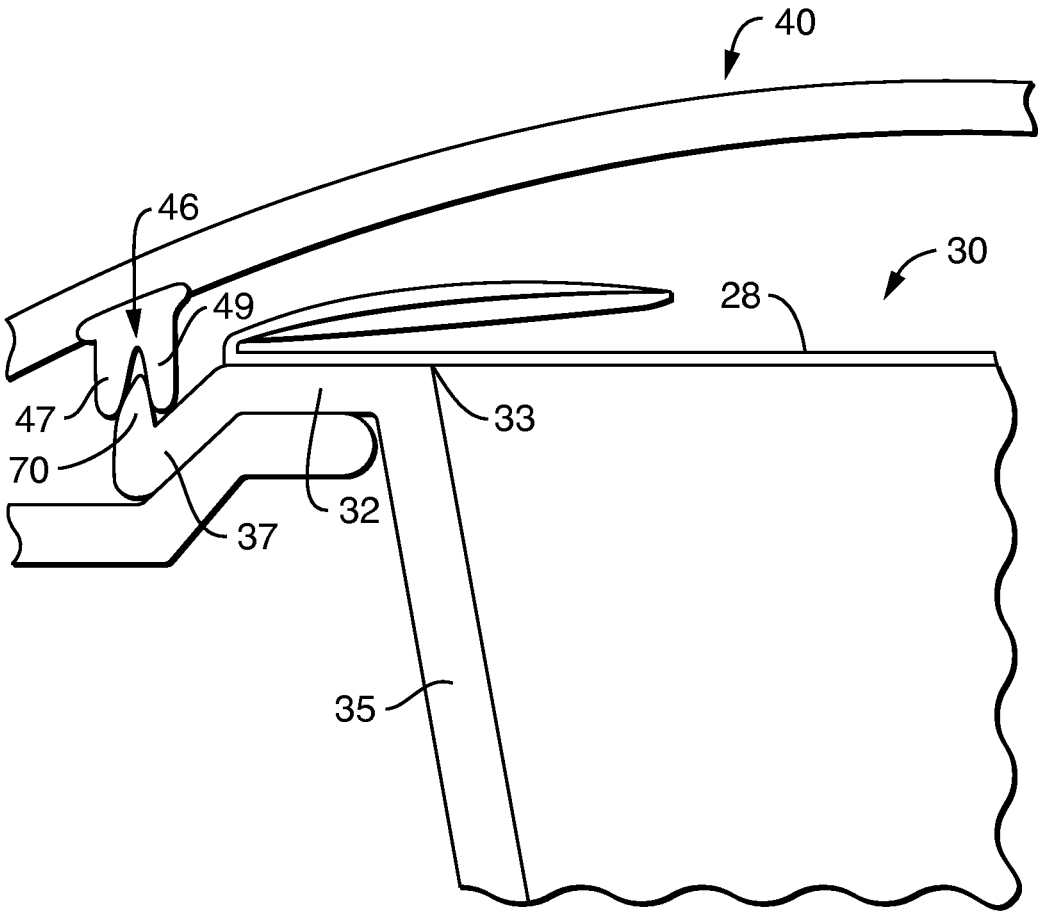
FIG. 5 is a detailed partial view illustrating the seal formed between a sealing member and a refill cartridge according to another embodiment of the present invention.

In still other embodiments, such as that illustrated in FIG. 5, the sealing member 46 comprises a first 47 and a second 49 molded elastomeric bead and the sealing surface comprises a skirt 37 having an upturned flange 70. In the illustrated embodiment the flange 70 has a first 72 and a second 74 top surface, which define a first 76 and a second plane 78. The sealing members 47, 49 contact the top surfaces 70, 72 to form a second seal. The second seal may lie above, below or parallel to the first seal. Preferably the planes defined by the top surface of the rim and the top surfaces of the flange are all different.

Regardless of whether the sealing member comprises one, two, three, or more beads or the like, each bead preferably contacts at least one sealing surface, which is preferably the top surface of the rim skirt. Further, it is preferred that the plane defining the sealing surface contacted by the sealing member lies in a plane that is different than the plane defining the top surface of the annular rim. In this manner, the cartridge provides at least two sealing surfaces lying in different planes. The first sealing surface is preferably contacted by a peelable seal to form a seal that is removable and only used a single time, while the second sealing surface is preferably contacted by the sealing member to form a resealable seal. The resealable seal is preferably formed each time the lid is closed and the sealing member is brought into contact with the top surface of the rim skirt.

Although the foregoing has been a description and illustration of specific embodiments of the invention, various modifications and changes thereto can be made by persons skilled in the art without departing from the scope and spirit of the invention.

What we claim is:

1. A resealable container system comprising a base, a refill cartridge and a lid having a sealing member, the refill cartridge having a top peripheral edge, an annular rim and a rim skirt extending from the annular rim, the annular rim having a first top surface lying in a first plane, and the rim skirt having a second top surface lying in a second plane, wherein the first and second planes do not lie in the same plane, a film peelably adhered to the first top surface forming a first seal and the sealing member contacting the second top surface when the lid is in a closed position forming a second seal.

2. The resealable container system of claim 1 wherein the sealing member surrounds at least a portion of the lid and is formed from a material different from the lid, and the sealing member sealingly engages with the second surface top surface when the lid is in a closed position.

3. The resealable container system of claim 1 wherein the sealing member comprises a thermoplastic elastomer.

4. The resealable container system of claim 1 further comprising a second sealing member disposed on the lid and a skirt having a third top surface lying in a third plane wherein the third plane does not lie in the same plane as the first or second planes.

5. The resealable container system of claim 1 wherein the first and the second planes define an angle $\alpha$ from about 30° to about 60°.

6. The resealable container system of claim 1 further comprising a wiping substrate disposed within the refill cartridge.

7. The resealable container system of claim 1 wherein the annular rim of the refill cartridge contacts the base when the refill cartridge is inserted into the base.

8. The resealable container system of claim 1 wherein the lid is connected to the base by a hinge.

9. The resealable container system of claim 1 wherein the refill cartridge has a cup shape and the first top surface is substantially flat.

10. A refillable wipes dispenser system comprising a cartridge having a wall portion defining a storage volume and an open top, the open top circumscribed by a peripheral edge, an annular rim having a first top surface lying in a first plane and a skirt extending from the annular rim, the skirt having a second top surface lying in a second plane, a first seal peelably adhered to the first top surface; a lid configured to cover the open top in a sealing arrangement, the lid comprising a cover portion, a lid peripheral edge and a sealing member disposed adjacent to the lid peripheral edge and configured such that when the lid is in a closed position the sealing member contacts the second top surface to form a second seal; and wherein the first and second planes do not lie in the same plane.

11. The system of claim 10 wherein the sealing member surrounds at least a portion of the lid and is formed from a material different from the lid.

12. The system of claim 10 wherein the sealing member comprises a thermoplastic elastomer.

13. The system of claim 10 further comprising a second sealing member disposed on the lid and a skirt having a third top surface lying in a third plane wherein the third plane does not lie in the same plane as the first or second planes.

14. The system of claim 10 wherein the first and the second planes define an angle $\alpha$ from about 30° to about 60°.

15. The system of claim 10 further comprising a wiping substrate disposed within the refill cartridge.

16. The system of claim 10 wherein the annular rim of the refill cartridge contacts the base when the refill cartridge is inserted into the base.

17. The system of claim 10 wherein the lid is connected to the base by a hinge.

18. The system of claim 10 wherein the second seal lies below the first seal.

19. The system of claim 10 wherein the second seal lies above the first seal.

* * * * *